United States Patent [19]

Goodman

[11] Patent Number: 5,067,241

[45] Date of Patent: Nov. 26, 1991

[54] ADJUSTABLE SPIRAL SLITTER FOR HOT DOGS

[76] Inventor: Morris G. Goodman, P.O. Box 629, Freehold, N.J. 07728-0629

[21] Appl. No.: 520,449

[22] Filed: May 8, 1990

[51] Int. Cl.[5] ..... B26B 29/00; B26B 3/00; B26B 29/06

[52] U.S. Cl. ..... 30/289; 30/278; 30/290

[58] Field of Search ..... 30/286, 287, 288, 289, 30/90.1, 278, 290

[56] References Cited

U.S. PATENT DOCUMENTS

| | | | |
|---|---|---|---|
| 3,257,728 | 6/1966 | Dignard | 30/290 |
| 3,528,325 | 9/1970 | Kamimura et al. | 30/90.1 |
| 3,572,189 | 3/1971 | Mathews | 30/90.1 |
| 3,940,842 | 3/1976 | Perrinelle et al. | 30/289 |
| 4,449,298 | 5/1984 | Putz | 30/90.1 |
| 4,587,731 | 5/1986 | Kramp | 30/90.1 |
| 4,689,882 | 9/1987 | Lorenz | 30/90.1 |
| 4,769,910 | 9/1988 | Moon | 30/90.1 |
| 4,799,406 | 1/1989 | Aguirrebeitia | 30/90.1 |
| 4,829,671 | 5/1989 | Cheng | 30/90.1 |

*Primary Examiner*—Douglas D. Watts
*Assistant Examiner*—Paul M. Heyrana, Sr.
*Attorney, Agent, or Firm*—Fleit, Jacobson, Cohn, Price, Holman & Stern

[57] ABSTRACT

An adjustable spiral slitter for hot dogs which includes a pair of generally semi-cylindrical or semi-circular members hingedly connected at one end and adjustably connected at the other end with the adjustably connected ends being separable to enable the semi-circular members to be pivoted between an open and closed position. One of the semi-circular members includes a serrated blade mounted therein with the serrated edge of the blade being oriented in an inclined relation to the center axis of the semi-circular members when they are in closed position. The semi-circular members, when in closed position, form an annular member with the blade edge generally parelling and spaced laterally from a diameter of the annular member extending between the pivotal connection and the adjustable connection between the two semi-circular members. The size of the interior of the annular member is adjustable by moving the adjustably connected ends to different adjusted positions to enable a hot dog having different circumferential sizes to be inserted through the slitter and rotated simultaneously with the serrated edge of the blade forming a spiral slit on surface of the hot dog. The hot dog can then be cooked in a pot, pan or grill with the slit enhancing the cooking operation, enhancing the flavor and appearance of the hot dog.

2 Claims, 1 Drawing Sheet

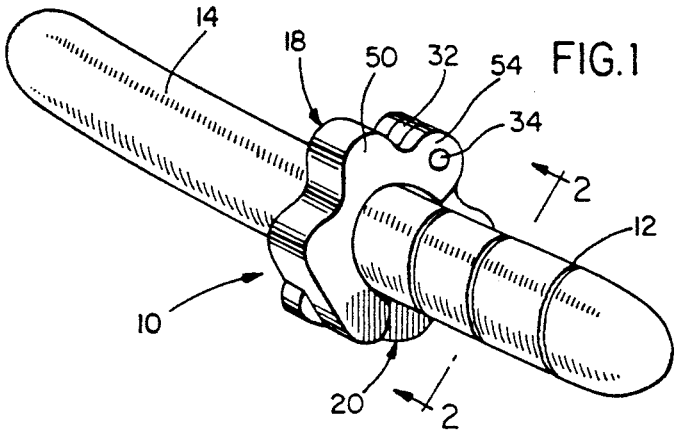
FIG.1
FIG. 2
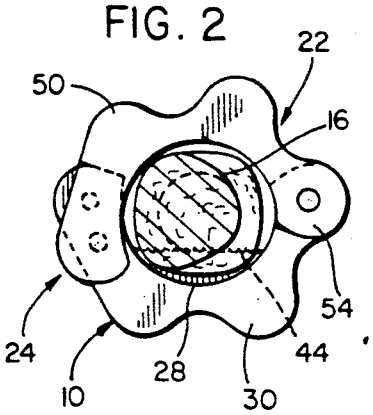
FIG. 3
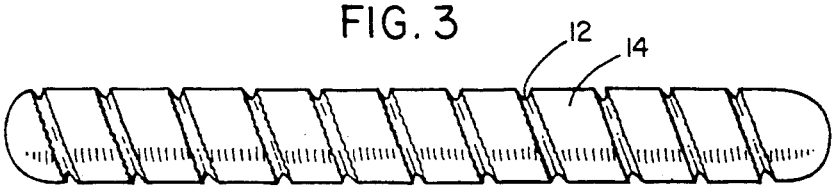
FIG. 4
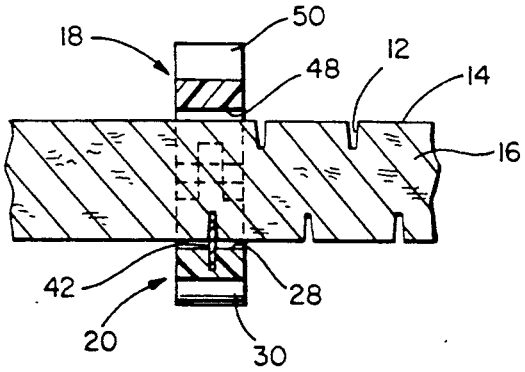
FIG. 5
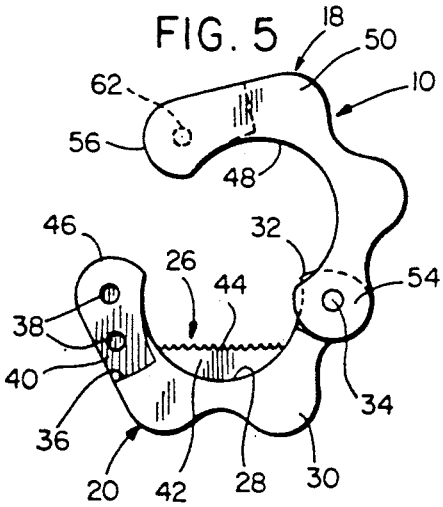
FIG. 6
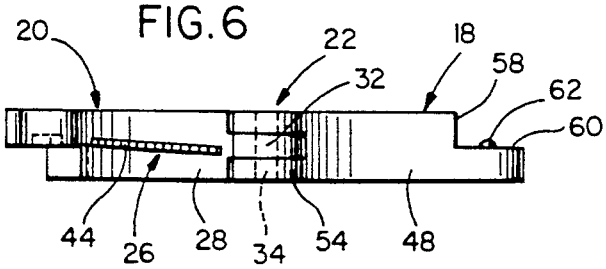

ADJUSTABLE SPIRAL SLITTER FOR HOT DOGS

BACKGROUND OF THE INVENTION

1. Field of the Invention

The present invention generally relates to a device to form a spiral slit in the exterior casing of a hot dog and more specifically to an adjustable spiral slitter for hot dogs which includes a pair of generally semi-cylindrical or semi-circular members hingedly connected at one end and adjustably connected at the other end with the adjustably connected ends being separable to enable the semi-circular members to be pivoted between an open and closed position. One of the semi-circular members includes a serrated blade mounted therein with the serrated edge of the blade being oriented in an inclined relation to the center axis of the semi-circular members when they are in closed position. The semi-circular members, when in closed position, form an annular member with the blade edge generally paralleling and spaced laterally from a diameter of the annular member extending between the pivotal connection and the adjustable connection between the two semi-circular members. The size of the interior of the annular member is adjustable by moving the adjustably connected ends to different adjusted positions to enable a hot dog having different circumferential sizes to be inserted through the slitter and rotated simultaneously with the serrated edge of the blade forming a spiral slit in the peripheral casing or surface of the hot dog with the slit extending partially into the ground meat within the hot dog casing. The hot dog can then be cooked in various conventional manners in a pot, pan or grill with the slit enhancing the cooking operation by eliminating the tendency of the hot dog to curl, enhancing the flavor and appearance of the hot dog and enabling the hot dog to be more easily inserted into a hot dog roll or bun.

2. Description of the Prior Art

Various products have been provided to condition food products for cooking. Such devices include various structures for forming slits or indentations in the external surfaces of various meat products to tenderize such products. Such devices also include annular members to remove corn kernels from a cob and devices for forming a circular slit in a cable for removing a sheath. The following U.S. patents relate to developments in the above-mentioned prior art. U.S. Pat. Nos.

240,556
2,050,768
4,114,266
4,587,731
4,689,882
4,799,406

None of the above listed prior art discloses the combination of a pair of pivotally connected semi-cylindrical or semi-circular components having an angled blade therein with the free ends of the pivotal components being detachably connected to enable them to be opened and adjusted with a hot dog being inserted therethrough in order to form a spiral slit in the peripheral casing of the hot dog.

SUMMARY OF THE INVENTION

An object of the present invention is to provide an adjustable spiral slitter for hot dogs in the form of an annular member constructed of a pair of semi-circular or semi-cylindrical components having one end pivotally connected and the other end detachably connected to enable the two components to pivot between open and closed positions with one of the components including a blade having a cutting edge angled in relation to a transverse plane that is perpendicular to the longitudinal center axis of the annular member to form a spiral slit in the external peripheral surface or casing of the hot dog as the hot dog is moved axially through the annular member and at the same time rotated about its own longitudinal axis.

Another object of the invention is to provide a hot dog slitter in accordance with the preceding object in which the detachably connected ends of the two components are provided with adjustable connecting means to enable the internal area of the annular member to be varied to receive hot dogs, frankfurters or the like having different circumferential dimensions and to enable variation in the depth of the slit formed in the hot dog casing and ground meat contained within the casing.

A further object of the invention is to provide a hot dog slitter in accordance with the preceding objects in which the blade is stationarily mounted and provided with a straight, serrated cutting edge which will effectively form a slit in the hot dog but will not injure a person's hand or finger in the event of contact therewith thereby providing a hot dog slitter which can be safely used and adjusted to receive various sizes of hot dogs and constructed of plastic to enable the device to be inexpensively manufactured and easily cleaned and sterilized for repeated use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the hot dog slitter of the present invention illustrating the manner of use thereof.

FIG. 2 is an end elevational view of the hot dog slitter taken along section line 2—2 on FIG. 1.

FIG. 3 is a side elevational view of a hot dog that has been provided with a spiral slit with the slitter of this invention.

FIG. 4 is a longitudinal, section view of the slitter and hot dog illustrating the relationship of the pivotal components, the hot dog and blade.

FIG. 5 is a side elevational view of the hot dog slitter illustrating the pivotal components in open position.

FIG. 6 is a top plan view of the slitter in completely open condition.

DESCRIPTION OF THE PREFERRED EMBODIMENT

Referring now specifically to the drawings, the hot dog slitter of the present invention is generally designated by reference numeral 10 and, as illustrated, the slitter forms a spiral slit 12 in the external peripheral surface or casing of a hot dog, frankfurter, weiner or similar product 14 which includes ground meat 16 in the interior thereof with the slit 12 extending through the external peripheral surface or casing of the hot dog 14 as well as into the ground meat 16 as illustrated in FIG. 4. When the hot dog 14 is cooked, it will retain its substantially straight condition rather than curling and will expand lengthwise in a conventional manner so the slit 12 formed therein will increase in dimension which will not only enhance the cooking operation but also enhance the appearance thereof and permit penetration of charcoal flavor and the like when grilled on a charcoal grill thereby enhancing the flavor of the hot dog.

The slitter 10 includes a pair of generally semi-cylindrical or semi-circular components 18 and 20 with a pivotal connection 22 connecting adjacent ends of the members 18 and 20 and an adjustable detachable connection 24 opposite the pivotal connection with a blade structure 26 being stationarily mounted in the member 20.

The member 20 includes a semi-cylindrical internal surface 28 and an undulating external surface 30. The end of the member 20 forming part of the pivotal connection 22 is recessed to form a lug 32 receiving a hinge pin 34 therethrough. The other end of the member 20 is provided with a lateral side recess 36 having a pair of spaced and aligned recesses 38 therein which are in the form of cylindrical depressions in the laterally facing surface 40 of the recess 36.

The portion of the semi-cylindrical surface 38 remote from the hinge pin 34 and recesses 38 is provided with a blade 42 having a straight but serrated edge 44 that is generally parallel to a diametric line extending between the hinge pin 34 and the recess 38 closest to the rounded free edge 46 of the member 20 as illustrated in FIG. 5. Also, the blade 42 is angled in relation to a transverse plane oriented perpendicular to the longitudinal axis of the slitter as illustrated in FIG. 6 with the angulation of the straight blade serving to form a spiral slit 12 in the hot dog 14 when the slitter is in a closed position and the hot dog moves longitudinally therethrough while being simultaneously rotated.

The semi-cylindrical or semi-circular member 18 also includes a semi-cylindrical inner surface 48 and an undulated external surface 50. The end of member 18 forming the pivotal connection 22 is bifurcated to form lugs 54 which receive lug 32 therebetween and receives the pivot pin 34 therethrough thereby pivotally connecting the members 18 and 20 for pivotal movement between a closed position illustrated in FIGS. 1, 2 and 4 and an open position illustrated in FIG. 6 with FIG. 5 illustrating the slitter in partial open position to facilitate assembly on a hot dog. The free end of the member 18 is rounded as at 56 and includes a lateral recess 58 extending in a direction opposite the lateral recess 38 and including a laterally disposed face 60 having a projecting ball-type detend 62 thereon which will engage with one of the spaced recesses 38 in the face 40 of the lateral recess 36 in the member 20 when in the closed position. When the detent 62 engages the outermost recess 38, the diameter of the interior cylindrical surface formed by the semi-cylindrical surfaces 28 and 48 will be relatively large and when the detent 62 is engaged with the innermost recess 38, the internal dimensional characteristics will change with the device not actually forming a cylindrical internal surface. The interior will be generally oval shaped to engage the blade edge 44 with a hot dog 14 having a smaller diameter thereby providing an adjustable hot dog slitter that can be effectively used for forming spiral slits in hot dogs having different circumferential dimensions.

As illustrated in FIGS. 2 and 5, the recess 36 at its inner end does not extend completely to intersect with the surface 28 thus leaving a curved, generally wedge shaped area 64 which has an arcuate outer surface that will generally conform with and frictionally engage the internal surface 48 of the member 18 when the two members 18 and 20 are pivoted to their smallest position as illustrated in FIG. 2 thus guiding and stabilizing the free end of the member 18 when it moves from a position with the detent 62 engaged with the outermost recess 38 to a position with the detent 62 engaged with and received in the innermost recess 38. The construction of the components of ABS plastic or equivalent material enables it to be constructed in an inexpensive manner and also enables it to be readily cleaned with the resiliency of the components and the construction of the hinge connection enabling lateral movement of the free ends of the members 18 and 20 sufficiently to enable engagement and disengagement of the detent 62 with the recesses 38. The undulated external surfaces enable the device to be easily and securely gripped and handled during use which is significant when considering that frequently the hands may be wet and the surfaces being gripped may become slippery due to contact with the external surfaces of the hot dog. Formation of the spiral slit enhances the appearance characteristics of the hot dog when it is cooked and also enables penetration of flavor, such as when cooked on a charcoal grill to enhance the taste characteristics thereof. Also, the spiral groove or slit 12 will serve to retain condiments which have a tendency to flow along the surface of the hot dog when held vertically or in an inclined position when eating especially when in a hot dog roll and external pressure is being applied to the roll to hold it while eating. Also, the spiral slit will enable uniform longitudinal expansion of the hot dog when it is cooked thereby preventing the hot dog from curling which frequently occurs and which renders the hot dog hard to handle and hard to place in a hot dog roll or bun.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An adjustable spiral slitter for hot dogs having an external casing completely enclosing a quantity of ground meat, said slitter comprising a pair of members having opposed semi-cylindrical recesses therein, means hingedly connecting said members at one end, means adjustably connecting said members at the other end with the adjustably connected ends being separable to enable the members to be pivoted between an open and closed position, one of said members including a straight blade mounted in the recess, said blade being oriented in an inclined relation to a transverse plane perpendicular to the longitudinal center axis of the semi-cylindrical recess, said blade having a straight cutting edge and being rigidly and stationarily affixed in said one member, said recesses forming an annular passage with the blade cutting edge generally paralleling and spaced laterally from a diameter of the annular passage with the size of the interior of the annular passage being adjustable by moving the adjustably connected ends to different adjusted positions to enable a hot dog having different circumferential sizes to be inserted through the slitter and rotated simultaneously with the cutting edge of the blade forming a spiral slit through the external casing of the hot dog with the slit extending only partially into the ground meat within the hot dog casing thereby leaving the casing and the ground meat integrally assembled thereby enabling the hot dog to be cooked in various conventional manners in a pot, pan or grill with the slit enhancing the cooking operation by eliminating the tendency of the hot dog to curl, enhancing the flavor and appearance of the hot dog and enabling the hot dog to be more easily inserted into a hot dog roll or bun.

2. The slitter as defined in claim 1 wherein said members are constructed of plastic material and said means adjustably connecting said members includes laterally facing surfaces on said members with one of the surfaces including spaced recesses and the other surface including a projecting detent for engagement with the recesses to vary the internal circumferential dimensions of the annular passage, said members having undulated external surfaces to facilitate gripping engagement therewith, said blade being transversely serrated.

* * * * *